US007431127B2

(12) United States Patent
de Borchgrave et al.

(10) Patent No.: US 7,431,127 B2
(45) Date of Patent: Oct. 7, 2008

(54) COMPACT NOISE SILENCER FOR AN AIR BLOWER

(75) Inventors: Adrien de Borchgrave, Canton, MI (US); Clifton Sprinkles, South Lyon, MI (US)

(73) Assignee: Durr Systems, Inc., Plymouth, MI (US)

( * ) Notice: Subject to any disclaimer, the term of this patent is extended or adjusted under 35 U.S.C. 154(b) by 273 days.

(21) Appl. No.: 11/227,744

(22) Filed: Sep. 15, 2005

(65) Prior Publication Data

US 2006/0060418 A1 Mar. 23, 2006

Related U.S. Application Data

(60) Provisional application No. 60/611,886, filed on Sep. 21, 2004.

(51) Int. Cl.
*F02M 35/00* (2006.01)

(52) U.S. Cl. ..... 181/229; 181/210; 123/198 E

(58) Field of Classification Search ..... 181/210, 181/229, 227, 224, 225, 281, 205, 284, 290; 123/198 E See application file for complete search history.

(56) References Cited

U.S. PATENT DOCUMENTS 1,380,473 A * 6/1921 Guarniery ..... 417/423.1
1,888,711 A * 11/1932 Bourne ..... 454/206
1,967,838 A * 7/1934 Norris ..... 454/206
2,160,269 A * 5/1939 Jorolemon ..... 126/113
3,426,866 A * 2/1969 Jensen ..... 181/224
3,540,547 A * 11/1970 Coward, Jr. ..... 181/225
3,726,359 A * 4/1973 Dierl et al. ..... 181/224
3,857,459 A * 12/1974 Adams et al. ..... 181/295
4,050,913 A * 9/1977 Roach ..... 96/381
4,173,267 A * 11/1979 Chatani ..... 181/199
4,334,588 A * 6/1982 Tezuka et al. ..... 180/68.6
4,362,222 A * 12/1982 Hellstrom ..... 181/30
4,420,526 A * 12/1983 Schilling et al. ..... 428/171
4,605,091 A * 8/1986 Iida et al. ..... 181/224
4,693,355 A * 9/1987 Bochi et al. ..... 193/2 R
4,750,860 A * 6/1988 Kelley ..... 415/119
5,141,073 A * 8/1992 Pelonis ..... 181/30
5,160,816 A * 11/1992 Chlop ..... 181/285
5,274,201 A * 12/1993 Steele ..... 181/224
5,455,097 A * 10/1995 Machida et al. ..... 428/116
5,471,537 A * 11/1995 Castwall ..... 381/71.3
5,532,439 A * 7/1996 Minkin ..... 181/224
6,015,026 A * 1/2000 McGrath ..... 181/295
6,589,112 B2 * 7/2003 Ruach ..... 454/276

(Continued)

FOREIGN PATENT DOCUMENTS

DE 4104963 * 6/1992

(Continued)

*Primary Examiner*—Lincoln Donovan
*Assistant Examiner*—Forrest Phillips
(74) *Attorney, Agent, or Firm*—Howard & Howard Attorneys, P.C.

(57) ABSTRACT

A compact noise silencer for a blower, including an L-shaped back wall having a sound adsorbent media and side walls defining a triangular enclosure, an inlet opposite one portion of the back wall and a central outlet opposite the back wall having a filter directing air into a blower. In the disclosed application, the blower directs air into a burner which heats the air for various applications.

10 Claims, 1 Drawing Sheet

U.S. PATENT DOCUMENTS

| | | | | |
|---|---|---|---|---|
| 6,640,926 | B2 * | 11/2003 | Weinstein | 181/224 |
| 6,668,970 | B1 * | 12/2003 | Lee | 181/224 |
| 6,688,966 | B2 * | 2/2004 | Akhtar | 454/235 |
| 6,880,813 | B2 * | 4/2005 | Yazici et al. | 261/29 |
| 6,892,851 | B2 * | 5/2005 | Lee | 181/224 |
| 6,920,959 | B2 * | 7/2005 | Han et al. | 181/224 |
| 6,953,104 | B2 * | 10/2005 | Monson et al. | 181/224 |
| 6,971,474 | B2 * | 12/2005 | Prosser et al. | 181/198 |
| 7,207,310 | B2 * | 4/2007 | Shaw et al. | 123/198 E |
| 2002/0015640 | A1 * | 2/2002 | Nishiyama et al. | 415/119 |
| 2002/0084138 | A1 * | 7/2002 | Weinstein | 181/268 |
| 2004/0040330 | A1 * | 3/2004 | Kosaka | 62/285 |
| 2004/0048036 | A1 * | 3/2004 | Nakasuji et al. | 428/95 |
| 2005/0161280 | A1 * | 7/2005 | Furuya | 181/225 |
| 2006/0060418 | A1 * | 3/2006 | de Borchgrave et al. | 181/229 |
| 2006/0185931 | A1 * | 8/2006 | Kawar | 181/202 |
| 2006/0254854 | A1 * | 11/2006 | Herrera et al. | 181/200 |
| 2007/0039318 | A1 * | 2/2007 | Krajewski et al. | 60/317 |

FOREIGN PATENT DOCUMENTS

| | | | |
|---|---|---|---|
| JP | 401273909 | * | 11/1989 |
| JP | 2000200441 | * | 7/1998 |
| JP | 2005283703 A | * | 10/2005 |

* cited by examiner

COMPACT NOISE SILENCER FOR AN AIR BLOWER

RELATED APPLICATIONS

This application claims priority to provisional application Ser. No. 60/611,886 filed Sep. 21, 2004.

FIELD OF THE INVENTION

This invention relates to a noise silencer for an air blower, such as an air blower for a combustion burner. The noise silencer of this invention is far more compact than commercially available sound or noise silencers, but provide at least as good sound attenuation as conventional noise silencers at less cost.

BACKGROUND OF THE INVENTION

Heater boxes are typically used to supply heated air to an oven to bake a product, such as paint on a vehicle body or other coated substrates. In a typical application, air is directed under pressure by a fan or blower to a burner and the heated air is then directed from the burner to a heater box. The burner mixes fuel, typically natural gas, with air and uses an ignition source to cause combustion and generate heat. Heated air is then generally directed from the burner to a heater box which is typically formed of insulated sheet metal. A circulation fan is generally used to circulate air through the heater box into an oven.

In a typical application, a centrifugal style air blower is used to supply combustion air to the burner. The movement of air through the inlet of such blowers creates a high sound level in the immediate vicinity of the heater box. Typically, the sound levels exceed those deemed safe for human exposure by the Occupational and Safety Health Administration (OSHA). However, sound silencers are commercially available which generally bolt onto the inlet of the blower. These sound silencers are stated to be capable of reducing or attenuating the sound levels by approximately 10 dB. However, one problem with commercially available sound silencers is their relatively large size. Typically, space is limited around the inlet of the combustion air blower, making installation of the sound silencer difficult, if not impossible. Further, commercially available sound silencers are relatively complex and therefore relatively expensive. A conventional sound silencer for this application generally includes a cylindrical housing having a pleated filter and a tubular duct or pipe directs air into the combustion blower. The open end of the cylindrical housing is the air inlet. Air is then received into the cylindrical housing through an annular opening surrounding the tubular duct or pipe and circulated through the air duct to the blower. Typically, the overall length of commercial sound silencers is twenty inches or greater.

As set forth above, however, space is limited around the inlet of the combustion air blower in a typical application. There is, therefore, a need for a noise silencer of this type which is more compact having the same or improved sound attenuation. It would also be desirable, particularly in retrofit applications, to have an improved noise silencer which clamps onto a standard air blower inlet filter using existing clamps. The noise silencer of this invention achieves these advantages.

SUMMARY OF THE INVENTION

The noise silencer for an air blower of this invention includes a housing having an L-shaped back wall having a sound adsorbent material thereon, including a first back wall and a second back wall, opposed side walls defining a generally triangular enclosure, an air inlet opposite the first back wall and an air outlet opposite the second back wall communicating with a blower. In the embodiment of the noise silencer of this invention for a combustion burner, the air outlet of the housing communicates with a blower directing air under pressure into a burner. The compact noise silencer of this invention has a substantially reduced overall length compared to conventional commercially available noise silencers and is simpler in construction and therefore reduced costs. Air enters the air silencer of this invention through the air inlet, which may be located at the top of the housing opposite the first back wall, and the angles of the noise silencer assist in guiding the air through the housing with minimal measurable pressure drop. Further, the noise silencer of this invention results in sound attenuation equal to or greater than commercially available sound silencers for this application with reduced cost.

In one preferred embodiment of the noise silencer of this invention, the second back wall has a greater length than the first back wall, wherein the second back wall has a length about twice the length of the first back wall. In the disclosed embodiment of the noise silencer of this invention, the angle between the first and second back walls is about ninety degrees, plus or minus about twenty degrees.

The preferred sound adsorbent material will be dependent upon the sound frequency spectrum produced by the air blower. Thus, the sound insulating material can be any material which has sound adsorbing properties, including fabric and polymer media. In one preferred embodiment disclosed herein, the sound adsorbing material is an open cell polymeric foam having spaced projections. As will be understood, however, spaced projections includes concave or convex projections. In the disclosed embodiment, the spaced projections are convex and pyramid-shaped or conical having a polygonal cross-section.

In one preferred embodiment of the noise silencer of this invention, the side walls of the housing are triangular and include a sound adsorbent material as described above. Further, in the disclosed embodiment, the air outlet of the housing or inlet of the blower is frustoconical having planar side walls and a reduced diameter at the inlet of the blower. The housing includes a rectangular flange portion which receives a filter, such as a conventional porous rubber, polymeric or fibrous filter.

As will be understood by those skilled in this art, various modifications may be made to the noise silencer of this invention within the purview of the appended claims. The following is a description of one preferred embodiment of the noise silencer of this invention which is disclosed for illustrative purposes only.

DESCRIPTION OF THE PREFERRED EMBODIMENTS

Figure 1:
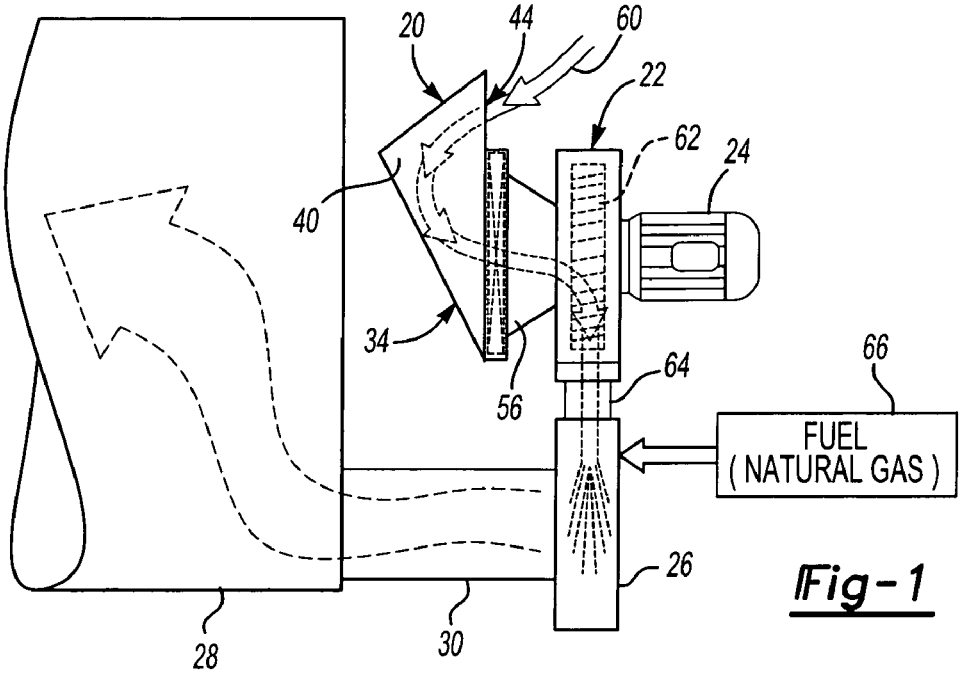
FIG. 1 is a side view of one embodiment of an air inlet and noise silencer for a blower illustrating the use of the noise silencer for delivery of heated air to a heated box.

As set forth above, the air inlet and noise silencer of this invention may be utilized to supply heated air to a heater box such, as used by the automotive industry to supply heated air to a dryer or paint oven. However, the noise silencer of this invention may be utilized for any application requiring noise reduction or attenuation of a blower supplying air under pressure for subsequent application. The noise silencer of this invention is compact, efficient and simple in design, therefore having a reduced cost. As shown in FIG. 1, the disclosed embodiment of the air inlet and noise silencer 20 of this invention is connected to a conventional blower 22 having a motor 24. The blower 22 directs gas under pressure to a burner 26 which directs heated air to a heater box 28 through duct 30. As described above, however, the noise silencer of this invention may be utilized for other applications.

Figure 2:
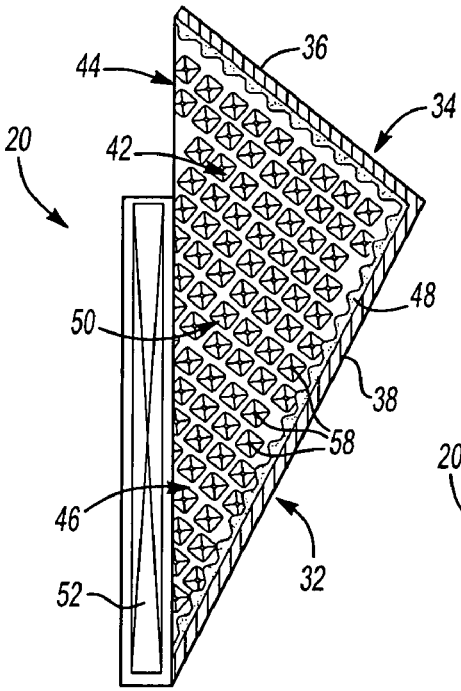
FIG. 2 is a side cross-sectional view of the noise silencer illustrated in FIG. 1.
Figure 3:
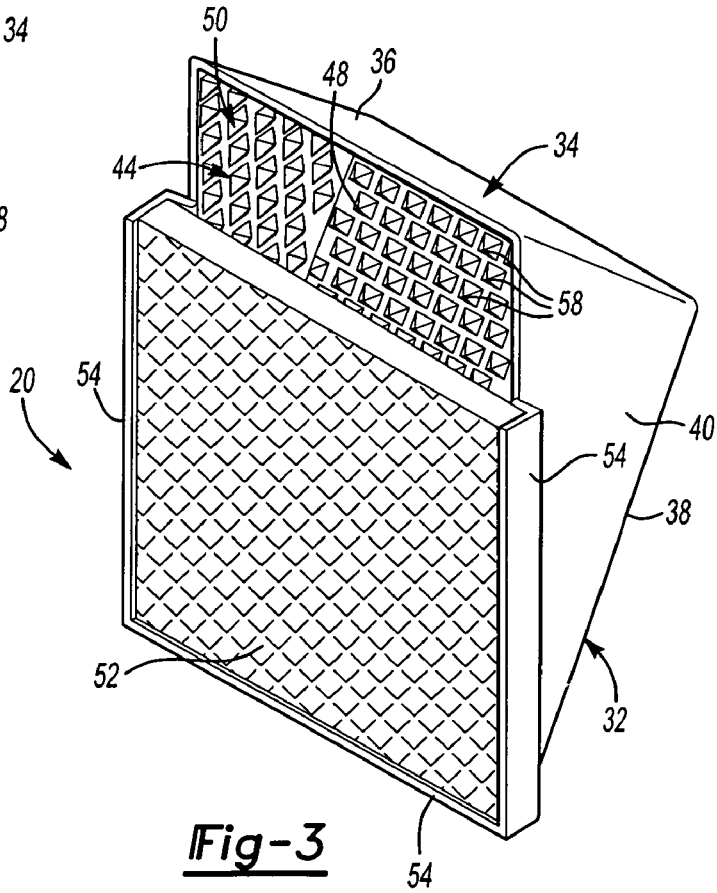
FIG. 3 is a side perspective view of the embodiment of the noise silencer illustrated in FIGS. 1 and 2.

As best shown in FIGS. 2 and 3, the disclosed embodiment of the noise silencer 20 of this invention includes a housing 32 including an L-shaped back wall 34 having a first back wall portion 36 and a second back wall portion 38 and opposed spaced side walls which, in the disclosed embodiment, extend perpendicular to the L-shaped back wall 34. In the disclosed embodiment, the side walls 40 are triangular and define in combination with the L-shaped back wall 34 a triangular enclosure 42 as shown in FIG. 2. The housing 32 includes an air inlet 44 opposite the first back wall 36 and a central air outlet 46 opposite the second back wall 38. In one preferred embodiment, the first and second back walls 36 and 38 are planar and the second back wall 38 is longer than the first back wall 36 as best shown in FIG. 2. In the disclosed embodiment, the second back wall 38 has a length equal to approximately twice the first back wall 36 and the angle defined between the first and second back walls 36 and 38, respectively, is about ninety degrees. In a preferred embodiment of the noise silencer 20 of this invention, the L-shaped back wall 34 includes sound adsorbent or sound attenuation media 48 as shown in FIGS. 2 and 3. Further, in the disclosed embodiment of the noise silencer 20, the side walls 40 also include sound adsorbent material 50.

In one preferred embodiment of the noise silencer 20 of this invention, the air outlet 46 includes a filter 52. As best shown in FIG. 3, the disclosed embodiment of the noise silencer 20 of this invention includes flange portions 54 extending from the side walls 40 and the end of the second back wall 38 which receives a conventional filter 52. The filter 52 may be any conventional filter adapted to remove particulates from the air stream, including porous rubber, fibrous filters or other filters. Further, as shown in FIG. 1, the air outlet of the housing includes a reducing diameter portion 56 which, in the disclosed embodiment, is frustoconical having planar side walls or pyramidal in shape, wherein the side walls are planar. However, as will be understood, any form of reducing diameter outlet may be used. Further, as set forth above, the preferred sound adsorbent material 48 and 50 will depend upon the sound frequency spectrum produced by the air blower 22. In one preferred embodiment, the sound adsorbent material includes a plurality of spaced projections to improve sound attenuation, which may be concave or convex. In the disclosed embodiment, the projections 58 are convex and pyramid-shaped or frustoconical as best shown in FIG. 3.

Having described a preferred embodiment of the noise silencer 20 of this invention, the function or operation of the noise silencer 20 may now be described with reference to FIG. 1. Air enters the noise silencer 20 through inlet 44 as shown by arrow 60. The air then enters the triangular enclosure 42 shown in FIG. 2 and is drawn by blower 22 against the L-shaped back wall 34, turning the air and directing the air in the enclosure through the outlet 46 and the filter 52 shown in FIGS. 2 and 3. The air outlet 46 is shown in FIG. 2. As set forth above, any blower or fan may be utilized with the noise silencer 20 of this invention. In the disclosed embodiment, the blower 22 includes blades or plates 62 which are driven by motor 24, directing air under pressure through duct 64 into the burner 26. A source of fuel 66, such as natural gas, is directed into the burner 26 which mixes with the air and an ignition source (not shown) causes combustion of the fuel, which heats the air to the desired temperature dependent upon the application. The heated air is then directed through duct 30 as required by the application. In this embodiment, heated air is directed through duct 30 by blower 22 into a heater box 28 which typically includes an internal insulation (not shown) and a circulation fan (not shown) is used to circulate air through the heater box 28 into an oven (not shown) as used, for example, by the automotive industry to heat or cure paint on a vehicle body. However, as described above, the noise silencer of this invention may be utilized for any application.

As set forth above, the disclosed embodiment of the noise silencer of this invention is for illustrative purposes only and various modifications may be made within the purview of the appended claims. In the disclosed embodiment, the housing 32 may be formed of sheet metal. However, other materials may also be utilized, including plastic. As also set forth above, the preferred angle defined between the first and second back walls 36 and 38 will also depend upon several factors. However, the preferred angle between the first and second back walls 36 and 38 is preferably about ninety degrees plus or minus twenty degrees. Finally, as also set forth above, the preferred adsorbent or sound attenuation material can be any material which has sound attenuation properties, including fabric and polymer media and the media effectiveness is dependent upon the sound frequency spectrum produced by the air blower 22. In actual testing of the embodiment of the noise silencer disclosed herein, the noise silencer reduced the sound levels by 10 to 15 dB within the immediate vicinity of the blower, which is equal to or better than commercially available sound silencers as discussed above. The compact air blower silencer of this invention is a simple three sided metal box which latches onto existent eye bolts for commercially available sound silencers, facilitating retrofitting the sound silencer of this invention onto conventional blowers. The overall length of the air silencer shown may be ten inches or less or about one half the overall length of commercially available sound silencers.

Having described one preferred embodiment of the compact noise silencer of this invention, the invention is now claimed, as follows.

The invention claimed is:

1. A noise silencer for a blower, comprising:

a housing including opposed spaced generally triangular side walls, an L-shaped back wall including a first back wall and a relatively inclined second back wall defining an angle of about ninety degrees, said L-shaped back wall extending from an outer edge of said generally triangular side walls defining a triangular enclosure having an air inlet at one end opposite said first back wall, an air outlet opposite said second back wall and a sound adsorbent material on said L-shaped back wall, said inlet directing air against said first back wall and said second back wall reflecting air out of said chamber.

2. The noise silencer as defined in claim 1, wherein said second back wall has a greater length than said first back wall and said first and second back walls are planar.

3. The noise silencer as defined in claim 1, wherein said side walls include sound adsorbent material.

4. The noise silencer as defined in claim 1, wherein said sound adsorbent material includes a plurality of spaced projections.

5. The noise silencer for a blower as defined in claim 4, wherein said spaced projections are cone-shaped and trapezoidal in cross-section.

6. The noise silencer as defined in claim 4, wherein said sound adsorbent material is an open cell polymeric foam.

7. The noise silencer as defined in claim 1, wherein said side walls are perpendicular to said L-shaped back wall.

8. The noise silencer as defined in claim 1, wherein said air outlet includes a filter.

9. The noise silencer as defined in claim 1, wherein said air outlet includes an inwardly tapered portion connected to a fan.

10. The noise silencer as defined in claim 1, wherein said air outlet communicates with a burner directing hot gas to a heater box.

* * * * *